US005092597A

United States Patent [19]

Kaminkow et al.

[11] Patent Number: 5,092,597

[45] Date of Patent: Mar. 3, 1992

[54] SOLID-STATE FLIPPER CONTROL CIRCUIT

[75] Inventors: Joseph E. Kaminkow, Arlington Heights; Edwin Cebula, West Chicago; Nicholas B. Wade, Waukegan, all of Ill.

[73] Assignee: Data East Pinball, Inc., Melrose Park, Ill.

[21] Appl. No.: 638,740

[22] Filed: Jan. 8, 1991

[51] Int. Cl.[5] ..... A63F 7/02; H01H 47/32

[52] U.S. Cl. ..... 273/129 V; 273/119 A; 273/129 R; 361/154

[58] Field of Search ..... 273/118 A, 119 A, 120 A, 273/121 A, 127, 129 R, 129 S, 129 V, 129 W; 200/61.1, 61.11, DIG. 23; 361/152, 154, 160, 170, 194, 195

[56] References Cited

U.S. PATENT DOCUMENTS

| | | | |
|---|---|---|---|
| 4,203,602 | 5/1980 | Kral | 273/121 |
| 4,384,716 | 5/1983 | Powers | 273/121 A |
| 4,399,483 | 8/1983 | Phelan | 361/154 |
| 4,511,945 | 4/1985 | Nielsen | 361/154 |
| 4,599,674 | 7/1986 | Ishikawa et al. | 361/154 |
| 4,790,536 | 12/1988 | Deger | 273/129 V |
| 4,895,369 | 1/1990 | Deger | 273/129 V |

*Primary Examiner*—William H. Grieb
*Assistant Examiner*—Jessica J. Harrison
*Attorney, Agent, or Firm*—Gerstman & Ellis, Ltd.

[57] ABSTRACT

A solid-state flipper control circuit for controlling the operation of a pinball machine includes a flipper, a flipper switch, and a solenoid coil for controlling the movement of the flipper. The flipper switch is formed as a microswitch having a common terminal connected to a ground potential and normally-open contact terminal. A solid-state driver circuit is provided which is responsive to the activation of the microswitch for generating momentarily a first voltage on its output terminal so as to move the flipper to the actuated position. The solid-state driver circuit includes a timer for automatically disconnecting the first voltage after a predetermined time and for generating subsequently a second voltage so as to hold the flipper in the actuated position until the microswitch is deactivated.

11 Claims, 2 Drawing Sheets

SOLID-STATE FLIPPER CONTROL CIRCUIT

BACKGROUND OF THE INVENTION

This invention relates generally to pinball machine flipper circuitry and more particularly, it relates to an improved solid-state flipper control circuit for controlling the operation of a pinball machine.

As is generally well known in the art of pinball machines utilizing pivotally mounted flippers, a relatively large amount of power is required for delivering strong pull on a solenoid core for the power stroke so as to move the flipper when the flipper switch is activated initially. However, a lesser amount of power is needed to hold or maintain the flipper when the flipper is already in the actuated position.

Heretofore, there is known in the prior art a pinball flipper circuitry which utilizes a high resistance solenoid holding coil and a second or low resistance coil connected substantially in parallel relationship across the holding coil. Such prior art pinball flipper circuitry arrangement as shown in FIG. 1 is described in U.S. Pat. No. 4,790,536 to Kurt W. Deger issued on Dec. 13, 1988, which is hereby incorporated by reference. In particular, the pinball game solenoid actuator 10 in the Deger patent is powered by a d.c. voltage source of about 50 volts connected between the positive terminal 12 and the ground terminal 14. The high resistance solenoid holding coil $N_h$ is connected across the d.c. voltage source through a normally-open flipper actuation switch 16. A normally-closed end-of-stroke switch 18 forms a series connection with the second or low resistance coil $N_s$, the resulting series combination being connected in parallel across the holding coil $N_h$.

In operation, wherein the flipper switch 16 is depressed upon game play activation, there will be generated currents through both of the coils $N_h$ and $N_s$ since the end-of-stroke switch 18 is normally closed. The combined magnetic flux from the coils $N_h$ and $N_s$ produces a sufficient force to move the flipper through the power stroke. At the end of the travel of the flipper, the end-of-stroke switch 18 is activated so as to open its contacts and thus remove the source of energy from the low resistance coil $N_s$. As a result, only the high resistance $N_h$ is energized to maintain the flipper in its already actuated position. Upon deactuation of the flipper switch 16, the high resistance coil $N_h$ and the flipper are returned to their deactivated states.

However, this parallel coil solenoid arrangement has several significant disadvantages. Firstly, this prior art arrangement suffers from the drawback of requiring two separate coils wherein both the low resistance and high resistance coils are energized initially so as to move the flipper through the power stroke and wherein only the high resistance coil is energized to maintain the flipper in the actuated position. The use of two separate coils increases manufacturing and assembly costs.

Secondly, the prior art arrangement requires that the flipper switch be capable of making and breaking a relatively large current through the respective low and high resistance coils with an associated result of possible arcing and contact wear on the terminal contacts of the flipper switch. Therefore, it will be noted that the flipper switch must be of the type capable of withstanding high currents, such as a leaf spring type contact switch having terminal contacts formed of tungsten, and thus is more costly to manufacture. Thirdly, the prior art arrangement has the disadvantage of requiring the use of an end-of-stroke switch which not only must break the high current but also increases the number of mechanical components.

There have been attempts made in the prior art to eliminate the need for a dual-winding solenoid coil and relay. For example, U.S. Pat. No. 4,384,716 to Emmett J. Powers issued on May 24, 1983, disclosed an electronic control circuit for controlling the operation of pinball machine flippers which includes a single solenoid coil. The same winding is energized to place the flipper in an actuator position and to hold the flipper in the actuated position. A full wave rectified voltage is applied to the single solenoid coil when the flipper switch is actuated so as to place the flipper in the actuated position. When the flipper has been sensed to be in the actuator position by a flipper sensor switch and a comparator, only a partial phase of the rectified voltage is applied to the solenoid coil to hold the flipper in the actuated state until the flipper switch is deactivated. However, this Powers patent still suffers from the disadvantage of requiring the need of the flipper sensor switch.

Further, in U.S. Pat. No. 4,895,369 to Kurt W. Deger issued on Jan. 23, 1990, and assigned to the same assignee of the present invention there is shown a flipper control circuit for a pinball machine having a flipper, a flipper switch for activating the flipper, means for holding the flipper in an actuated position until the flipper switch is deactivated, and a solenoid coil for controlling the movement of the flipper in response to the voltage applied to the solenoid coil. A first voltage is applied to the solenoid coil when the flipper switch is activated. A second holding voltage is applied to the solenoid coil when the flipper is in the actuated position to hold the flipper in the actuated position until the flipper switch is deactivated. An end-of-stroke switch electrically disconnects the first voltage from the solenoid coil when the flipper is in the actuated position. However, this later Deger patent has the above discussed disadvantage of requiring a flipper switch that must be capable of making and breaking a high current as well as the necessity of using an end-of-stroke switch.

SUMMARY OF THE INVENTION

Accordingly, it is a general object of the present invention to provide an improved solid-state flipper control circuit for controlling the operation of pinball machines which is relatively simple and economical to manufacture and assemble, but yet overcomes the disadvantages of the prior art flipper control circuitry.

It is an object of the present invention to provide an improved solid-state flipper control circuit for controlling the operation of pinball machines which eliminates the need of a dual-winding solenoid coil and an end-of-stroke switch.

It is another object of the present invention to provide an improved solid-state flipper control circuit for controlling the operation of pinball machines which utilizes a flipper switch formed of a solid-state microswitch, thereby reducing manufacturing cost and is easier to adjust and service.

It is still another object of the present invention to provide an improved solid-state flipper control circuit which includes a flipper switch formed of a solid-state microswitch and a solid-state flipper solenoid driver circuit responsive to the actuation of the microswitch for controlling the movement of the flipper.

In accordance with these aims and objectives, the present invention is concerned with the provision of an improved solid-state flipper control circuit for controlling the operation of a pinball machine which includes a flipper, a flipper switch, and a solenoid coil for controlling the movement of the flipper. The flipper switch is formed of a microswitch having a common terminal connected to a ground potential and a normally-open contact terminal. The solid-state flipper control circuit further includes a solid-state flipper solenoid drive circuit which has a control signal input terminal connected to the normally-open contact terminal of the microswitch and an output terminal connected to one end of the solenoid coil.

The solenoid coil has its other end connected to the ground potential. The solid-state driver circuit is responsive to the actuation of the microswitch for generating momentarily a first voltage on the output terminal so as to move the flipper to the actuated position. The solid-state driver circuit further includes timer means for automatically disconnecting the first voltage on the output terminal after a predetermined time and for generating subsequently a second voltage on the output terminal to hold the flipper in the actuated position until the microswitch is deactivated.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein:

FIGS. 4(*a*) and 4(*b*) are waveforms useful in understanding the operation FIGS. 2 and 3.

DESCRIPTION OF THE PREFERRED EMBODIMENT

Figures 1, 2, 4A, 4B:
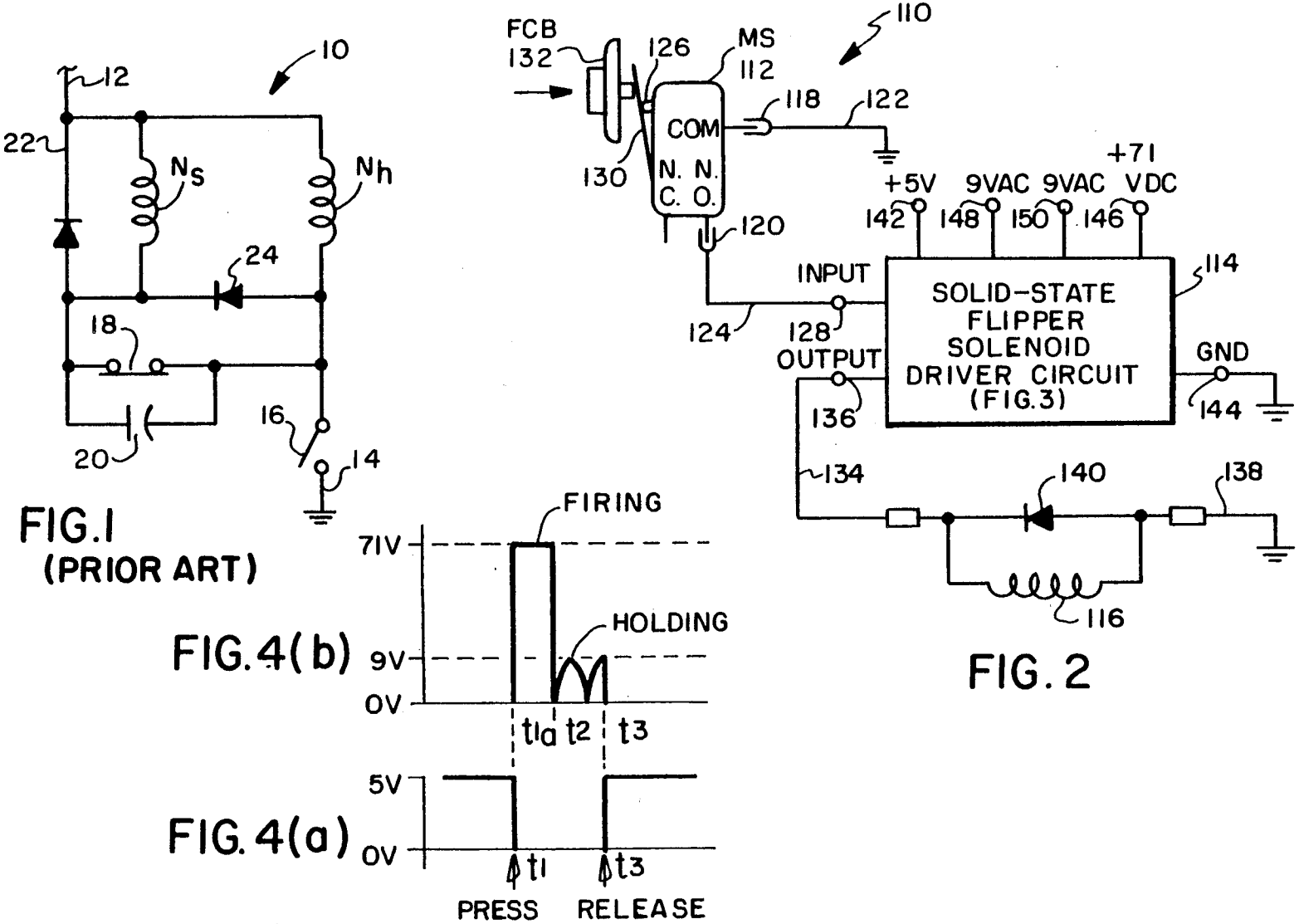
FIG. 1 (PRIOR ART)
FIG. 1 is a schematic circuit diagram of a prior art parallel coil flipper solenoid arrangement.
FIG. 2 is a schematic representation of the solidstate flipper control circuit of the present invention.

Referring now in detail to the drawings, there is illustrated in FIG. 2 a schematic representation of a solid-state flipper control circuit 110 of the present invention. The flipper control circuit 110 includes a flipper switch 112, a solid-state flipper solenoid driver circuit 114, and a single unitary solenoid coil 116. By comparison of the solid-state flipper control circuit 110 of the present invention with the conventional flipper control circuit of FIG. 1, it can be readily seen that there has been eliminated the need of two separate solenoid coils as well as the necessity of an end-of-stroke switch.

The flipper switch 112 is preferably formed of a microswitch having common contact terminal 118 and a normally-open contact terminal 120. The common contact terminal 118 is connected by a lead line 122 to a ground potential. The normally-open contact terminal 120 is connected by a lead line 124 to the control signal input terminal 128 of the driver circuit 114. The microswitch 112 has a pushbutton 126 which is depressible for activating or closing the electrical connection between the lines 122 and 124. The pushbutton 126 is mechanically coupled via lever arm 130 to a cabinet flipper control button 132 mounted on the side of the pinball machine. The cabinet control button 132 is used conventionally by the pinball machine player or operator for controlling the movement of the flipper.

The solenoid coil 116 controls a solenoid plunger which itself controls the movement of the flipper. One end of the solenoid coil 116 is connected via lead line 134 to the output terminal 136 of the driver circuit 114. The other end of the solenoid coil is connected via a lead line 138 to the ground potential. A clamping diode 140 is connected across the solenoid coil for limiting the voltage rise at the output terminal 136 when the flipper control button 132 is released.

Figure 3:
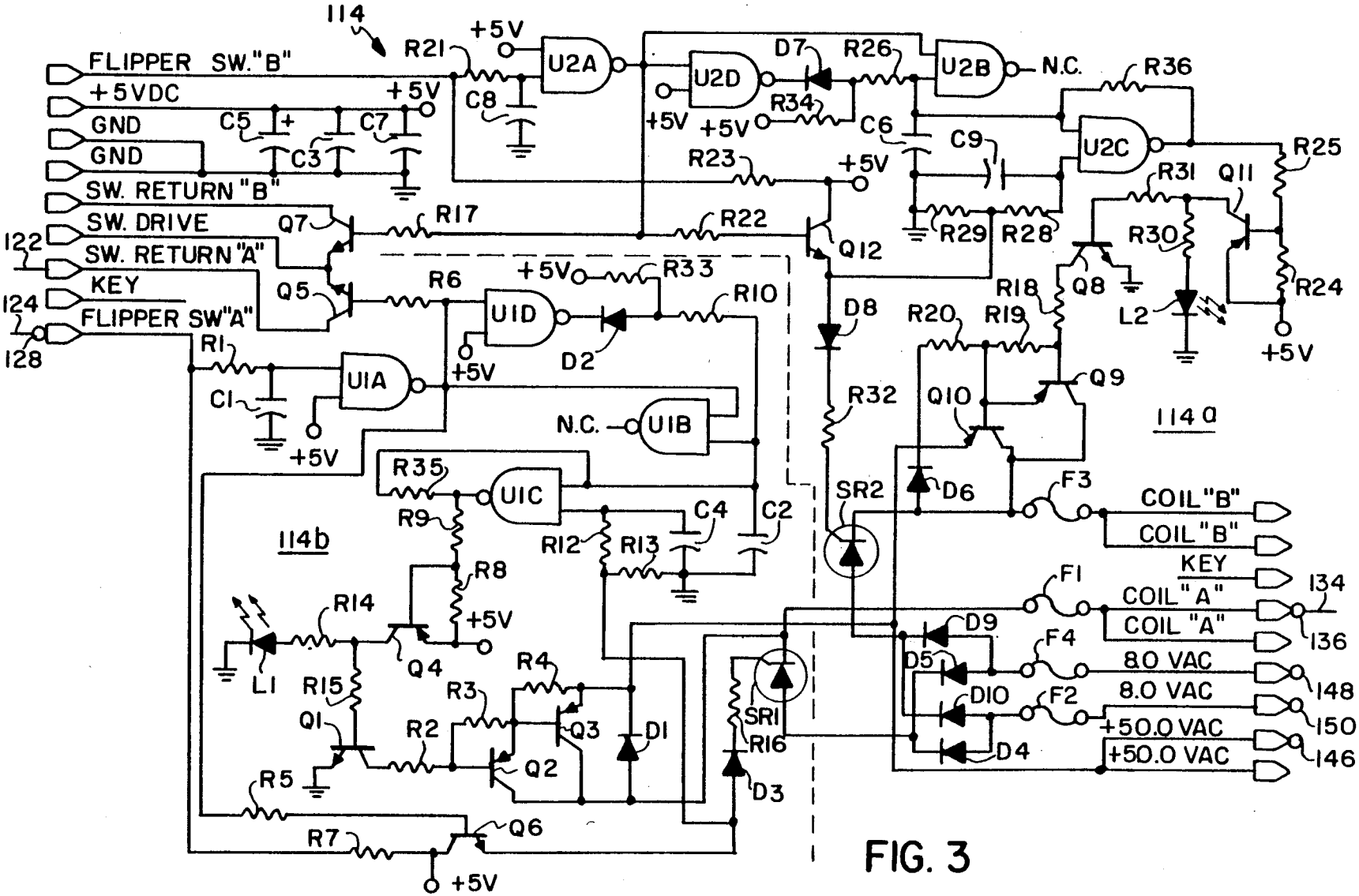
FIG. 3 is a detailed circuit diagram of the solidstate flipper solenoid driver circuit for use in FIG. 2.

The solid-state flipper solenoid driver circuit 114 receives a low d.c. voltage, which is typically +5.0 VDC, connected between a first power supply terminal 142 and a ground terminal 144. The driver circuit 114 also receives a high d.c. voltage, which is typically +71.0 VDC connected between a second power supply terminal 146 and a ground terminal 144. Further, an alternating current of approximately 9 VAC is supplied to the driver circuit 114 across the third and fourth power supply terminals 148 and 150. A detailed schematic circuit diagram of the solid-state flipper solenoid driver circuit 114 is shown in FIG. 3 of the drawings.

Referring in particular to the waveforms in FIGS. 4(*a*) and 4(*b*) of the drawings, the operation of the driver circuit 114 of FIG. 3 will now be explained. Initially, it should be noted that the driver circuit 114 is actually a dual solenoid driver circuit for controlling a pair (left and right) of flippers. The dual solenoid driver circuit 114 is comprised of a left solenoid driver circuit 114*a* for controlling the left flipper and a right solenoid driver circuit 114*b* for controlling the right flipper. Since the driver circuits 114*a* and 114*b* are identical in their construction and operation, it will be sufficient to describe in detail the operation of only the right solenoid driver circuit 114*b* used on conjunction with the right flipper and its associated components.

The driver circuit 114*b* is comprised of a one-shot multivibrator functioning as a timer, a high voltage driver for generating a firing voltage, and a low voltage driver for generating a holding voltage. The one-shot multivibrator is formed by the NAND logic gate U1*a*, U1*d*, and U1*c* which receives an input control signal from the control signal input terminal 136 and generates an output signal at the output of the NAND logic gate U1*c*. This output signal is used to control the high voltage driver which consists of the transistors Q4, Q1, Q2 and Q3, and the diode D1. The timer length is controlled by the resistors R10 and R33 and the capacitor C2 which are used to set a predetermined amount of time, i.e., 20 milliseconds, in which the transistor Q3 is turned on so as to supply the firing voltage. The low voltage driver is formed of a silicon-controlled rectifier SR1 whose gate electrode is triggered by the transistor Q6 so as to provide the holding voltage which is a rectified, unfiltered (pulsating) d.c. voltage.

In operation, when the further control button 132 is depressed at the time t1 in FIG. 4(*a*) the control signal input terminal 128 will be grounded due to the closing of the normally-open contact 120 of the flipper switch 112. Since the flipper switch is required only to switch the low d.c. voltage of +5.0 volts, which draws a relatively small amount of current, it can be implemented as a smaller and less costly microswitch. As a result, the output terminal 136 will be driven momentarily to the high d.c. voltage of +71.0 VDC between the times t1*a* and t2, as shown in FIG. 4(*b*). The output terminal 136 will remain at +71.0 VDC until the time t2 due to the triggering of the multivibrator and at which time the transistor Q3 will be turned off. This high d.c. voltage provides the actuation power to the solenoid coil 116 and thus moves the plunger and the interconnector flipper through the power stroke. Consequently, the flipper will be in the actuated position.

Simultaneously, the gate of the silicon-controlled rectifier SR1 of the low voltage driver will be triggered at the time t2 so as to provide a full wave rectified unfiltered voltage of 9 VAC to the solenoid coil 116. This rectified voltage provides the holding power for maintaining the flipper in the actuated position. When the flipper control button 132 is released at the time t3, the microswitch will return to its normally-open position and the silicon-controlled rectifier SR1 will be turned off due to the non-conduction of the transistor Q6. This will in turn cause the voltage at the output terminal 136 to drop to zero at the time t3*a*. As a result, no voltage will be applied to the solenoid coil 116. This completes the operation of one cycle of the flipper control button 132.

From the foregoing detailed description, it can thus be seen that the present invention provides an improved solid-state flipper control circuit for controlling the operation of pinball machines which utilizes a microswitch as the flipper switch. Further, the present solid-state flipper control circuit has eliminated the need for using the end-of-stroke switch. A solid-state driver circuit is provided which is responsive to the activation of the microswitch for generating momentarily a first voltage on the output terminal so as to move the flipper to the actuated position. The solid-state driver circuit automatically disconnects the first voltage after a predetermined time and generates a second voltage so as to hold the flipper in the actuator position until the microswitch is deactivated.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. In a pinball machine having a flipper and including a flipper switch and a solenoid coil for controlling the movement of the flipper, the improvement comprising in combination:

said flipper switch being formed of a microswitch having a common terminal connected to a ground potential and a normally-open contact terminal;

solid-state flipper solenoid driver circuit means having a control signal input terminal connected to the normally-open contact terminal of said microswitch and an output terminal connected to one end of said solenoid coil;

said solenoid coil having its other end connected to the ground potential;

said solid-state driver circuit means being responsive to the activation of said microswitch for generating momentarily a first voltage on the output terminal so as to move the flipper to the actuator position; and said solid-state driver circuit means further including timer means for automatically disconnecting said first voltage on the output terminal after a predetermined time and for generating subsequently a second voltage on the output terminal to hold the flipper in the actuated position until said microswitch is deactivated.

2. In a pinball machine as claimed in claim 1, wherein said timer means is comprised of a one-shot multivibrator.

3. In a pinball machine as claimed in claim 1, wherein said solid-state driver circuit means includes a high voltage driver circuit for generating the first voltage.

4. In a pinball machine as claimed in claim 1, wherein said solid-state driver circuit means includes a low voltage driver circuit for generating the second voltage.

5. In a pinball machine as claimed in claim 4, wherein said low voltage driver circuit is formed of a silicon-controlled rectifier.

6. In a pinball machine having a flipper and including a flipper switch and a solenoid coil for controlling the movement of the flipper, the improvement comprising in combination:

said flipper switch being formed of a microswitch having a common terminal connected to a ground potential and a normally-open contact terminal;

solid-state flipper solenoid driver circuit means having a control signal input terminal connected to the normally-open contact terminal of said microswitch and an output terminal connected to one end of said solenoid coil;

said solenoid coil having its other end connected to the ground potential;

said solid-state driver circuit means being responsive to the activation of said microswitch for generating momentarily a high d.c. voltage on the output terminal so as to move the flipper to the actuator position; and said solid-state driver circuit means further including timer means for automatically disconnecting said high d.c. voltage on the output terminal after a predetermined time and for generating subsequently a lower rectified and unfiltered voltage on the output terminal to hold the flipper in the actuated position until said microswitch is deactivated.

7. In a pinball machine as claimed in claim 6, wherein said timer means is comprised of a one-shot multivibrator.

8. In a pinball machine as claimed in claim 6, wherein said solid-state driver circuit means includes a high voltage driver circuit for generating the high d.c. voltage.

9. In a pinball machine as claimed in claim 6, wherein said solid-state driver circuit means includes a low voltage driver circuit for generating the lower rectified voltage.

10. In a pinball machine as claimed in claim 9, wherein said low voltage driver circuit is formed of a silicon-controlled rectifier.

11. In a pinball machine having a flipper and including a flipper switch and a solenoid coil for controlling the movement of the flipper, the improvement comprising in combination:

said flipper switch being formed of a microswitch having a common terminal connected to a ground potential and a normally-open contact terminal;

solid-state flipper solenoid driver circuit means having a control signal input terminal connected to the normally-open contact terminal of said microswitch and an output terminal connected to one end of said solenoid coil;

said solenoid coil having its other end connected to the ground potential;

said solid-state driver circuit means including a high voltage driver circuit being responsive to the activation of said micro-switch for generating momentarily a first voltage on the output terminal so as to move the flipper to the actuator position; and said solid-state driver circuit means further including timer means for automatically disconnecting said first voltage on the output terminal after a predetermined time and a low voltage driver circuit for generating subsequently a second voltage on the output terminal to hold the flipper in the actuated position until said microswitch is deactivated.

* * * * *